US012030531B2

(12) United States Patent
Mehlan

(10) Patent No.: US 12,030,531 B2
(45) Date of Patent: Jul. 9, 2024

(54) DRIVER'S COMPARTMENT FOR AN INTEROPERABLE RAIL VEHICLE

(71) Applicant: SIEMENS MOBILITY GMBH, Munich (DE)

(72) Inventor: Markus Mehlan, Karlsfeld (DE)

(73) Assignee: Siemens Mobility GmbH, Munich (DE)

( * ) Notice: Subject to any disclaimer, the term of this patent is extended or adjusted under 35 U.S.C. 154(b) by 853 days.

(21) Appl. No.: 16/972,658

(22) PCT Filed: May 9, 2019

(86) PCT No.: PCT/EP2019/061913

§ 371 (c)(1),
(2) Date: Dec. 7, 2020

(87) PCT Pub. No.: WO2019/233699

PCT Pub. Date: Dec. 12, 2019

(65) Prior Publication Data

US 2021/0261171 A1 Aug. 26, 2021

(30) Foreign Application Priority Data

Jun. 6, 2018 (DE) ..... 10 2018 208 888.8

(51) Int. Cl.
*B61C 17/04* (2006.01)

(52) U.S. Cl.
CPC ..... *B61C 17/04* (2013.01)

(58) Field of Classification Search
CPC ..... B61C 17/04; B64D 43/00
See application file for complete search history.

(56) References Cited

U.S. PATENT DOCUMENTS

2013/0193732 A1* 8/2013 Brand ..... B60N 2/0745 297/344.21
2014/0159926 A1* 6/2014 Van Staagen ..... G01C 23/00 340/971

FOREIGN PATENT DOCUMENTS

| | | | | |
|---|---|---|---|---|
| AU | 2003203693 | A1 | 11/2004 | |
| CN | 1681696 | A | 10/2005 | |
| CN | 102282053 | A | 12/2011 | |
| CN | 202225869 | U | 5/2012 | |
| CN | 107176176 | A * | 9/2017 | |
| CN | 107274878 | A * | 10/2017 | |
| DE | 7023235 | U | 9/1970 | |
| DE | 102005013245 | A1 | 9/2006 | |
| DE | 102006043110 | A1 * | 3/2008 | ..... B61C 17/04 |

(Continued)

OTHER PUBLICATIONS

UIC Code 651: "Layout of driver's cabs in locomotives, railcars, multiple unit trains and driving trailers", 4th edition, Jul. 2002, Union Internationale des Chemins de Fer (UIC), Paris.

(Continued)

*Primary Examiner* — Robert J McCarry, Jr.
(74) *Attorney, Agent, or Firm* — Laurence A. Greenberg; Werner H. Stemer; Ralph E. Locher

(57) ABSTRACT

A driver's cab for an interoperable rail vehicle has a front window and a seat arrangement with two seats for operating personnel. A standard field of view is defined for each of the seats. The standard fields of view overlap at least partially in the projection thereof onto the front window. There is also described a rail vehicle.

6 Claims, 2 Drawing Sheets

(56) References Cited

FOREIGN PATENT DOCUMENTS

| | | | |
|---|---|---|---|
| RU | 149428 | U1 | 1/2015 |
| WO | 2011009643 | A1 | 1/2011 |

OTHER PUBLICATIONS

Official Journal of the European Union: "Regulation (EU) Nr. 1302/2014—Vehicles—Locomotives and passenger vehicles", vol. 57, Dec. 12, 2014, ISSN 0376-9453 (p), https://eur-lex.europa.eu/legal-content/DE/TXT/PDF/ [downloaded Oct. 25. 2018]—Statement of Relevance.

Norm: DIN EN 16186-1, "Bahnanwendungen—Fuhrerraum", Mar. 2015, [Railway application—Driver's cab—Part 1: Anthropometric data and visibility]—English version EN16186-1:2014+A1:2018, English translation of DIN EN 16186-1:2019-04.

* cited by examiner

DRIVER'S COMPARTMENT FOR AN INTEROPERABLE RAIL VEHICLE

BACKGROUND OF THE INVENTION

Field of the Invention

The invention relates to a driver's compartment for an interoperable rail vehicle and to an interoperable rail vehicle.

When developing driver's compartments for interoperable rail vehicles, it is necessary to take numerous normative requirements into consideration, resulting in little free design leeway. Key influencing factors here are the field of view to the outside, anthropometric data, accommodation of operator-control and indicating devices in the gripping region and region of view of the traction vehicle driver, and crash requirements.

Accordingly, the driver's compartment must for example be constructed in such a way that the traction vehicle driver has an unrestricted region of view from his seated driving position in order to see positionally fixed signals to the left and right of the track when the vehicle is situated on a straight track or in curves having a curve radius of at least 300 m.

The usable available space in the driver's compartment is usually sufficient for the intended functionalities for 1-man operation by a vehicle driver. However, in some European countries (for example Italy, Czech Republic, Slovakia, Poland), a second man is required for the operational tasks, for example for actions according to the four-eye principle or for additionally safeguarding the driving operation. The accommodation of the second man (driver's assistant) in the driver's compartment under the aforementioned conditions requires solutions that are complicated to some extent.

SUMMARY OF THE INVENTION

It is an object of the present invention to specify a structurally more favorable construction for a driver's compartment of an interoperable rail vehicle.

This object is achieved according to the invention by a driver's compartment for an interoperable rail vehicle as claimed and by an interoperable rail vehicle as claimed.

The driver's compartment stated at the outset for an interoperable rail vehicle comprises a front window and a seat arrangement. The latter has two seats for operating personnel, for each of which seats a standard field of view is defined. Here, the standard fields of view at least partially intersect in the projection thereof onto the front window.

The driver's compartment or driver's cab of a rail vehicle refers to a cabin or a compartment or a space for the vehicle driver. It is preferably substantially enclosed by walls, arranged for example in a driving car and is usually situated at one end of the rail vehicle. It preferably comprises operator-control elements and/or indicating elements which are necessary for operating the rail vehicle.

The operating personnel comprises the vehicle driver, who directly steers the rail vehicle or indirectly steers it in a responsible manner. Furthermore, the personnel comprises a further person as driver's assistant who, as described above, performs further tasks or additional monitoring of the vehicle driver, for example according to the four-eye principle. The driver's assistant therefore has essentially the same requirements placed on him in terms of the viewing conditions as the vehicle driver, since it is only thus that he can satisfy his monitoring tasks.

The seat arrangement according to the invention comprises two seats which are preferably arranged in the driver's compartment in such a way as to meet the requirement placed on interoperability, in particular the standardized requirements placed on the viewing conditions. Here, one of the seats is preferably assigned to the vehicle driver and the other to the driver's assistant. The seats are preferably fixedly connected to further components of the driver's compartment, that is to say for example bolted, riveted, welded or the like. In other words, the seats are positioned and installed in the driver's compartment at their respective seat position in such a way that a sufficient field of view is ensured as prescribed both for the vehicle driver and the driver's assistant.

The seats preferably have adjustment possibilities and for this purpose adjustment means by which they can be ergonomically adapted to the body characteristics of the operating personnel. It is thus possible for example for the positions, in particular the height and/or the angular position of seat surfaces, of the backrests, armrests and/or headrests, to be adjusted as required. Furthermore, the seats are preferably configured in such a way that they meet the further standard requirements.

The standard field of view is defined for the operating personnel on the basis of the respective seat position. In this context, the standard field of view takes anthropometric data into consideration. With the view of the vehicle driver directed straight ahead, this standard field of view substantially indicates a region around the central vision that at least ensures the recognition of track-side reference points (for example signals) which are defined by corresponding standards for interoperable vehicles (EN 16186-1). It thus generally represents the minimum requirements placed on a standardized field of view.

The standard field of view can vary in the vertical plane depending on the size of the traction vehicle driver. Thus, for example, the characterization of a so-called eye reference point takes as its starting point standard sizes of the operating personnel of between 1.55 m and 1.92 m and 30 mm addition (for shoes). However, this size dependency is substantially of negligible relevance for the invention, since it has only an insignificant influence, if any, on the distance between the seats.

With regard to the invention, the extent of the field of view in the horizontal plane is of greater relevance. This can preferably be described with the aid of the track-side reference points which extend in the horizontal direction around a vehicle center axis (see above). The vehicle center axis is arranged in the longitudinal direction, that is to say in the direction of the longest extent of the rail vehicle or in the direction of travel (x direction). A viewing axis describes the center of the field of view and extends substantially in the direction of travel, that is to say substantially parallel to the vehicle center axis. Deviations in the direction of the viewing axis from the direction of travel can result here on the basis of the standardized definition of the field of view. An origin of the field of view lies in each case in an eye reference point which in turn lies on a seat center plane. The seat center plane is defined for each seat and extends centrally through it in a plane in the direction of travel and perpendicularly thereto in the vertical direction (x-z plane). The viewing axis in the direction of travel and starting from the eye reference point thus represents the center of a view of the respective operating person or of the respective second man that is directed substantially straight ahead in the direction of travel.

By simple geometrical construction it is possible for the standard field of view assigned to the respective seat to be projected onto the front window. The front window is arranged in front of the seats in the direction of travel and is preferably designed in such a way that it satisfies the normative requirements, such as for example bulletproofness, transparency properties, reflection properties and the like. The standard fields of view of the vehicle driver and driver's assistant thus extend through the front window. Accordingly, there must be no structures situated permanently in the standard fields of view that constitute a viewing obstacle. That is to say that, in particular, no columns, pillars, struts, etc. must be arranged in this region. Even though the distance of the seats from the front window is variable in principle, it cannot be arbitrarily selected within the technical and normative possibilities. The reason is that with the distance the size of the projection surface of the standard fields of view on the front window increases, and therefore, on the basis of the normative viewing requirements, an ever greater area must be kept free of structural or load-bearing elements, such as pillars and/or struts. Accordingly, the seats have to be positioned relatively close to the front window in order to be able to ensure sufficient structural integrity of the driver's compartment.

According to the invention, the standard fields of view of the two seats intersect or are superimposed or overlap. That is to say that, unlike in the prior art to date, there is an overlapping region between the standard field of view of the vehicle driver and that of the driver's assistant. Up until now, they have usually been arranged so far away from one another that the vehicle driver and the driver's assistant were each assigned a dedicated region of the front window. It was frequently routine practice hitherto for the individual regions of view to be separated by a pillar. By contrast, the seats are, according to the invention, arranged more centrally, that is to say more in the middle with respect to the side walls of the driver's compartment (or in the y direction). Therefore, they are also positioned or arranged closer to one another and have a smaller spacing than was customary hitherto.

While keeping substantially the same distance of the seats from the front window as in the prior art, the arrangement according to the invention of the seats results in the fact that the front window, without restricting the two standard fields of view, can be configured to be narrower and nevertheless satisfies the normative requirements placed on the viewing conditions. This advantageously results in more favorable structural design possibilities for the driver's compartment. Thus, for example, a smaller glass area for the field of view is required and there result new design possibilities for the front portion. It is thus possible for example to achieve a simpler arrangement of the load-bearing structures and/or an aerodynamically more favorable design. The smaller distance between the two seats (in the y direction) additionally leads to the fact that indicating or operator-control elements arranged for example in front consoles can also be better seen or operated by the respective driver's assistant. This is a TSI requirement that could previously be met only critically. It is thus possible for the driver's assistant in any emergency situation advantageously also to intervene directly with the corresponding instruments of the vehicle driver and take control over them.

As will be explained in more detail later, the arrangement according to the invention of the seats makes another design of the escape routes possible. As a result, the length of the driver's compartment can be reduced overall, and therefore, for the same length of the rail vehicle as hitherto, more useful area is available according to the invention.

The interoperable rail vehicle stated at the outset comprises at least one driver's compartment according to the invention. What is to be understood by a rail vehicle for the purposes of the invention is a vehicle which travels or is guided on a railway by means of one or more rails. In this context, the vehicle and the rail are a closely coordinated system which is customarily referred to as a wheel-rail system. The rails preferably consist of steel and are arranged in pairs and in parallel as tracks.

Interoperability refers in the present case to the capability of cross-border interaction, that is to say the international compatibility, of different systems for rail vehicles. It is substantially achieved by standardization. In order to ensure the interoperability, it is the case, in particular within the European Union, that (minimum) requirements detailed by comprehensive standards and regulations are stipulated for rail vehicles.

The rail vehicle according to the invention is configured in particular as a traction vehicle, that is to say it is a driven, preferably motor-driven, rail vehicle. For example, the traction vehicle can be a rail vehicle which is driven electrically, by means of fuel cells and/or by an internal combustion engine. The rail vehicle according to the invention comprises at least one driver's compartment according to the invention, that is to say precisely one or more than one. For example, a driver's compartment according to the invention can be arranged one at each end of the rail vehicle.

Further particularly advantageous embodiments and developments of the invention will become apparent from the dependent claims and from the following description, with it being the case that the independent claims of one category of claims can also be developed analogously to the dependent claims of another category of claims and the description thereof and, in particular, also individual features of various exemplary embodiments or variants can be combined to form new exemplary embodiments or variants.

The two seats preferably each have a seat center plane. Here, the distance (y distance) of the seat center planes from one another is preferably less than 95 cm, particularly preferably less than 90 cm, and is very particularly preferably approximately 80 cm.

These distances between the two seats are substantially less than hitherto customary, and therefore, as already explained above, structurally particularly favorable configurations of the driver's compartment are possible. Between the two seats, however, there advantageously remains a sufficient distance which is not perceived by the operating personnel to be unpleasant.

The two seats preferably each have a seat center plane. The distance thereof from a side wall, in particular the nearest side wall, is preferably more than 50 cm. Here, the seat center plane is a plane which extends vertically and in the direction of travel and centrally divides or bisects the seat. There is thus provided for the operating personnel, in an emergency situation, a sufficient escape route to the rear, that is to say counter to the direction of travel away from the front window. Here, the escape route is arranged as a side corridor in each case adjacent to a nearest side wall of the driver's compartment, with the result that the operating personnel do not have to share the escape route in this first section. In the first section, the escape routes for the vehicle driver and driver's assistant are thus advantageously separated. The side corridors additionally allow simpler arrangement and accessibility of the entry doors.

Moreover, in this configuration of the arrangement, there is still sufficient clearance in the front region ahead of the seats toward the side walls, thereby allowing an installation space to be provided. This can be used for example for 19-inch installation units.

A center console is preferably arranged between the two seats. Here, the center console constitutes a spatial separation and can be configured for example as an armrest. Alternatively or additionally, it can preferably comprise a cup/bottle holder, a coolbox, storage possibilities and/or the like.

The center console preferably comprises operator-control elements. The operator-control elements of the center console are advantageously conveniently accessible both for the vehicle driver and for the driver's assistant, and therefore an otherwise possibly required doubling of the operator-control elements can be avoided in a cost-saving manner. During travel pauses, the center console can particularly preferably be folded to the side or lowered, with the result that still higher comfort for the operating personnel is achieved.

In order to satisfy the intra-community requirements placed on rail vehicles, the interoperable rail vehicle, and in particular the driver's compartment according to the invention, are preferably configured in accordance with the regulation "TSI Loc&Pas" (REGULATION (EU) no. 1302/2014 of the Commission of Nov. 18, 2014). Accordingly, the standard fields of view are preferably defined in accordance with the standard "EN 16186", to which reference is made in the regulation "TSI Loc&Pas".

The invention will be once again explained in more detail below with reference to the appended figures on the basis of exemplary embodiments. Here, identical components are provided with identical reference numbers in the various figures. Relative direction indications, such as for example "top", "bottom", "front", "rear", etc., relate to a rail-guided rail vehicle when used as intended. Here, "front" and "rear" are to be understood in relation to the direction of travel. The figures are as a rule not true to scale. In the figures:

DETAILED DESCRIPTION OF THE INVENTION

Figure 1:
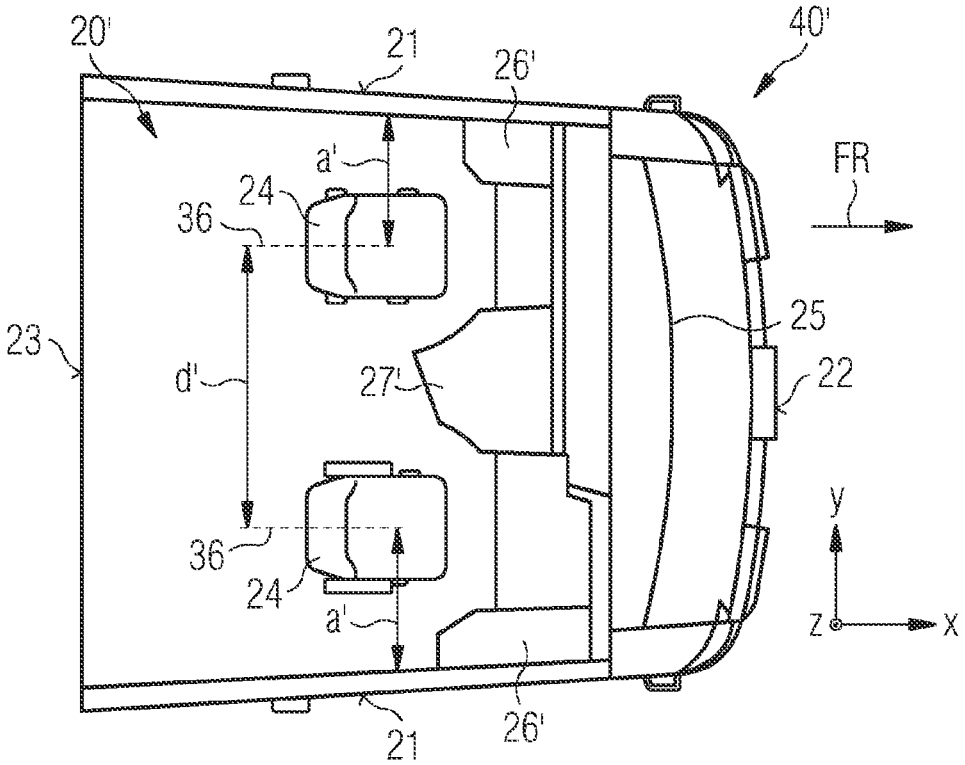
FIG. 1 shows a schematic sectional illustration of a driver's compartment of a rail vehicle according to the prior art.

FIG. 1 shows by way of example a schematic sectional illustration of a driver's compartment 20' for a rail vehicle 40' according to the prior art. The rail vehicle 40' has a direction of travel FR in which it usually travels during operation. That is to say that it is driven in the direction of travel FR (x direction) while being guided on rails. Without limiting the generality, a vertical, upwardly pointing direction is referred to as the z direction and a direction perpendicular to the x direction and to the z direction is referred to as the y direction in the description. x, y and z direction together form a right-hand coordinate system.

The rail vehicle 40' comprises a driver's compartment 20'. It is surrounded by a front wall 22, which points in the direction of travel FR, a rear wall 23 opposite to the front wall 22, and two mutually opposite side walls 21. The driver's compartment 20' also has a floor and a ceiling (not shown here). A transparent, substantially rectangular front window 25 is arranged in the front wall 22.

In the driver's compartment 20' there are arranged two seats 24 for operating personnel, that is to say for a vehicle driver and a driver's assistant. The seats 24 are positioned here in such a way that operating personnel sitting on them during operation have a view through the front window 25 looking straight ahead in the direction of travel FR. These seats each have a seat center plane which extends vertically and in the direction of travel FR. The seat center plane divides the seat in half in each case. The seat center planes are arranged at a distance d' of 130 cm. The distance a' of the seat center planes from the side walls 21 is approximately 35 cm.

A side console 26' with operator-control elements and/or indicating elements (not shown here) is arranged obliquely forward from a seat 24 toward the respectively nearest side wall 21. Additionally arranged in front of and centrally between the seats 24 is a center console 27' which has, facing the vehicle driver and the driver's assistant, different operator-control surfaces which in turn comprise operator-control elements and/or indicating elements.

Figure 2:
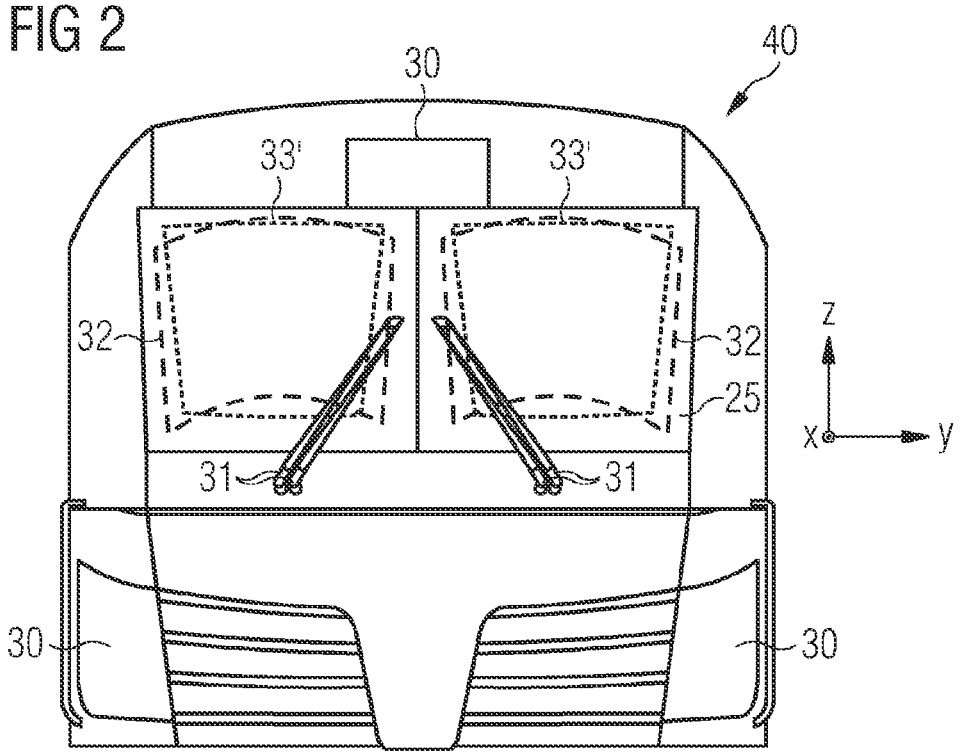
FIG. 2 shows a schematic front view of the driver's compartment from FIG. 1.

FIG. 2 illustrates the rail vehicle 40 from FIG. 1 in a front view, that is to say as viewed toward the front wall 22. The front wall 22 has the customary elements for rail vehicles, such as for example lighting means 30, a window wiper system comprising two window wipers 31 which, being motor-driven, sweep over a wiping region 32, and the like.

Two projections 33' of standard fields of view, as are the prior art to date, are illustrated in dashed lines on the front window 25 of the front wall 22. They thus characterize the standard fields of view of the operating personnel for the respectively assigned seat 24. As a result of the distance d' of the seat center planes from one another being large by comparison with the invention, the projections 33' of the standard fields of view are spaced apart from one another and thus have no overlapping region. The front window 25 is approximately as large as required in order to provide the space for the standard fields of view.

Figure 3:
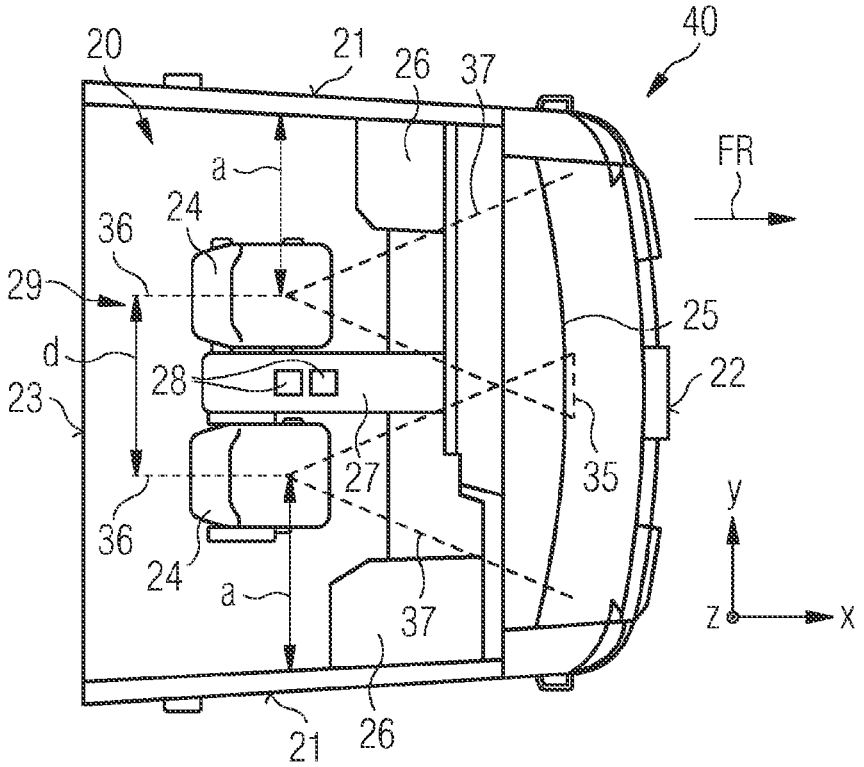
FIG. 3 shows a schematic sectional illustration of an exemplary embodiment of a driver's compartment according to the invention of a rail vehicle.

FIG. 3 shows, by way of example and schematically, a sectional illustration through an exemplary embodiment of a rail vehicle 40 according to the invention with an exemplary embodiment of a driver's compartment 20 according to the invention which has a seat arrangement 29. Since the driver's compartment 20 is similar in its basic outlines to that illustrated in FIG. 1 and FIG. 2, only the differences will be discussed below.

In the case of the seat arrangement 29 according to the invention, the two seats 24 are arranged closer together. That is to say that the seat center planes are preferably arranged at a distance d which is less than 95 cm, particularly preferably less than 90 cm. With particular preference, the distance d is approximately 80 cm. Accordingly, the seats 24 are also further away from the side walls of a 20, with the result that there is a distance a of at least 50 cm between a seat 24 and the nearest side wall 21.

Between the two seats 24 there is arranged a center console 27 which spatially separates the two seats 24 from one another. The center console 27 here has by way of example two operator-control elements 28 which can equally well be reached by the vehicle driver and by the driver's assistant and can be operated by both of them. It is possible in principle, however, for any desired number of operator-control elements 28 to be arranged on the center console 27. Since according to the invention there is more space available between the seats 24 and the side walls 21, the side consoles 26 arranged obliquely toward the side walls 21 in front of the seats 24 can advantageously be configured to be larger, for example to receive installations such as 19-inch racks.

Figure 4:
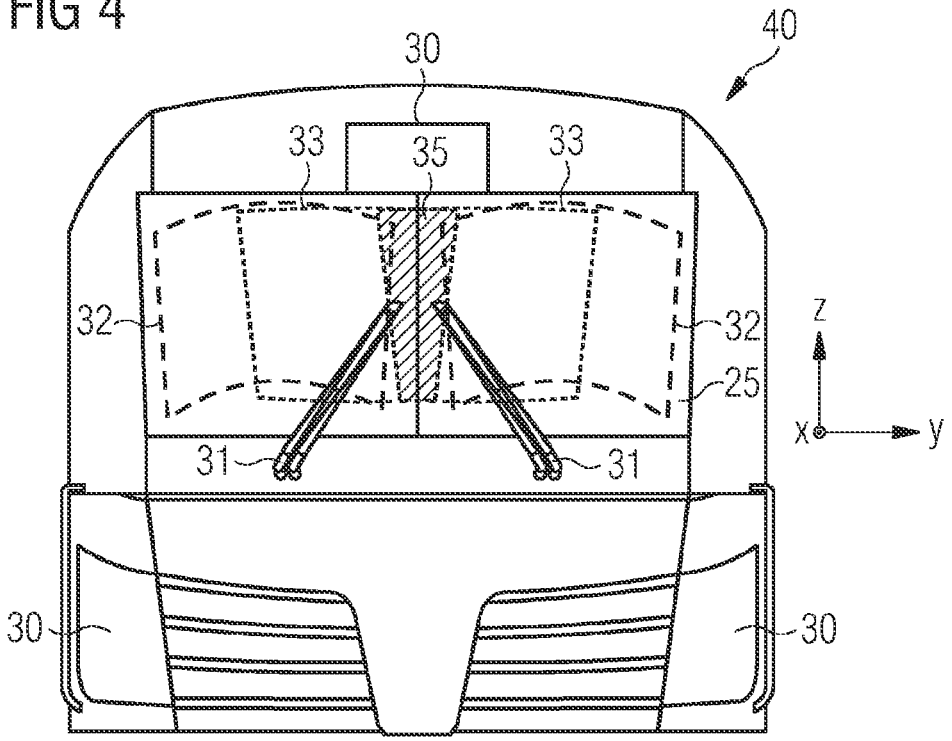
FIG. 4 shows a schematic front view of the driver's compartment from FIG. 3.

A key difference over the prior art illustrated in FIG. 1 and FIG. 2 lies in the fact that, by virtue of the more compact seat arrangement 29, the standard fields of view 37 of the vehicle driver and driver's assistant overlap in the projection 32 thereof on the front window 25. An intersecting or overlapping region 35 is formed as a result. As is particularly evident from FIG. 4, it is then no longer the case that almost the entire area of the front window 25 is taken up by the projections 32 of the standard fields of view 37. It is therefore possible for the front window 25 to be made smaller in relation to the prior art while observing the standard requirements (TSI Loc&Pas, EN 16186). This advantageously makes it possible for the front portion of the rail vehicle 40 to be configured in an aerodynamically and/or statically more favorable manner.

Finally, it should once again be pointed out that the arrangements described in detail above are merely exemplary embodiments which can be modified by a person skilled in the art in a wide variety of ways without departing from the scope of the invention. Furthermore, the use of the indefinite article "a" or "an" does not rule out the possibility that the relevant features can also be present multiply. Nor do the terms "arrangement" and "element" rule out the possibility that the relevant component consists of a plurality of interacting subcomponents which, where appropriate, can also be distributed spatially.

The invention claimed is:

1. A driver's compartment for an interoperable rail vehicle having a front window, the driver's compartment comprising:

a seat arrangement with two seats for operating personnel, each of said two seats having a defined standard field of view;

said two seats including a seat assigned to a vehicle driver and a seat assigned to a driver's assistant;

said standard fields of view intersecting at least partially in a projection onto the front window;

a center console arranged between said two seats, said center console having operator-control elements that are required for operating the rail vehicle, and said operator-control elements of said center console being disposed to be accessible to the vehicle driver and to the driver's assistant;

each of said two seats being spaced from a side wall of the driver's compartment to leave a free spacing distance of more than 50 cm, thus defining an escape route for the operating personnel, in an emergency situation, the escape route enabling an escape to the rear, counter to a direction of travel and away from the front window, along a side corridor formed between said seat and a respectively nearest side wall of the driver's compartment; and said seats being spaced from one another by a spacing distance that is smaller than the free spacing distance defining the escape route, and said center console substantially occupying a space defined by the spacing distance between said seats.

2. The driver's compartment according to claim 1, wherein each of said two seats has a seat center plane and a distance between said seat center planes of said two seats is less than 95 cm.

3. The driver's compartment according to claim 2, wherein the distance between said seat center planes is less than 90 cm.

4. The driver's compartment according to claim 2, wherein the distance between said seat center planes is approximately 80 cm.

5. An interoperable rail vehicle, comprising at least one driver's compartment according to claim 1.

6. The interoperable rail vehicle according to claim 5 being a traction vehicle.

* * * * *